US006744218B2

(12) United States Patent
Kang et al.

(10) Patent No.: US 6,744,218 B2
(45) Date of Patent: Jun. 1, 2004

(54) METHOD OF DRIVING A PLASMA DISPLAY PANEL IN WHICH THE WIDTH OF DISPLAY SUSTAIN PULSE VARIES

(75) Inventors: Kyoung-Ho Kang, Suwon (KR); Seung-Hun Chae, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/384,552

(22) Filed: Mar. 11, 2003

(65) Prior Publication Data

US 2003/0197474 A1 Oct. 23, 2003

(30) Foreign Application Priority Data

Apr. 18, 2002 (KR) ..... 2002-21192

(51) Int. Cl.[7] ..... G09G 3/10

(52) U.S. Cl. ..... 315/169.3; 315/169.4; 345/63; 345/68

(58) Field of Search ..... 315/169.3, 169.4; 345/63, 68

(56) References Cited

U.S. PATENT DOCUMENTS 5,446,344 A * 8/1995 Kanazawa ..... 315/169.4

* cited by examiner

*Primary Examiner*—David Vu
(74) *Attorney, Agent, or Firm*—McGuire Woods LLP

(57) ABSTRACT

A plasma display panel driving method, in which a reset step, an address step, and a display sustaining step are performed on unit subfields, is provided. In the reset step, the charge states of display cells to be driven are uniformed. In the address step, wall charges with a predetermined voltage are formed on only display cells to be turned on. In the display sustaining step, alternating current pulses are applied to all of the display cells, so that only the display cells having the wall charges perform display discharge. In embodiments, the width of AC pulses and portions of the pulses applied to all of the display cells varies in the display sustaining step.

20 Claims, 12 Drawing Sheets

METHOD OF DRIVING A PLASMA DISPLAY PANEL IN WHICH THE WIDTH OF DISPLAY SUSTAIN PULSE VARIES

BACKGROUND OF THE INVENTION

1. Field of the Invention

The present invention relates to a driving method of plasma display panels, and more particularly, to a plasma display panel driving method in which a reset step, an address step, and a display sustaining step are performed on unit subfields.

2. Background Description

FIG. 1 shows the structure of a general 3-electrode surface-discharge type plasma display panel 1. FIG. 2 shows a display cell of the plasma display panel 1 of FIG. 1. Referring to FIGS. 1 and 2, address electrode lines $A_{R1}$, $A_{G1}$ through $A_{Gm}$, and $A_{Bm}$ (not shown are the ranges $A_{R1}$–$A_{Rm}$ and $A_{B1}$ through $A_{Bm}$), front dielectric layer 11 and rear dielectric layer 15, Y electrode lines $Y_1$ through $Y_n$, X electrode lines $X_1$, through $X_n$, a fluorescent layer 16, barrier ribs 17, and a magnesium monoxide (MgO) layer 12 as a protective membrane are provided between front glass substrate 10 and rear glass substrates 13 of the general surface-discharge type plasma display panel 1.

The address electrode lines $A_{R1}$, $A_{G1}$ through $A_{Gm}$, and $A_{Bm}$ are disposed on the front surface of the rear glass substrate 13 in a predetermined pattern, and entirely coated with the rear dielectric layer 15. The barrier ribs 17 are formed parallel to the address electrode lines $A_{R1}$, $A_{G1}$ through $A_{Gm}$, and $A_{Bm}$ on the front surface of the rear dielectric layer 15. The barrier ribs 17 define a discharge area on each display cell and prevents an optical cross-talk between display cells. The fluorescent layer 16 is formed between the barrier ribs 17.

The X electrode lines $X_1$, through $X_n$ and the Y electrode lines $Y_1$ through $Y_n$ are formed on the rear surface of the front glass substrate 10 in a predetermined pattern so that they intersect the address electrode lines $A_{R1}$, $A_{G1}$ through $A_{Gm}$, and $A_{Bm}$ at right angles. Each intersection corresponds to a display cell. To form each of the X electrode lines $X_1$ through $X_n$, a transparent conductive electrode line $X_{na}$ of FIG. 2, such as an indium tin oxide (ITO), is combined with a metallic electrode line $X_{nb}$ of FIG. 2 for increasing conductivity. Likewise, to form each of the Y electrode lines $Y_1$ through $Y_n$, a transparent conductive electrode line $Y_{na}$ of FIG. 2, such as an indium tin oxide (ITO) is combined with a metallic electrode line $Y_{nb}$ of FIG. 2 for increasing conductivity. The X electrode lines $X_1$ through $X_n$ and the Y electrode lines $Y_1$ through $Y_n$ are entirely coated with the front dielectric layer 11. The magnesium monoxide (MgO) layer 12, for protecting the panel 1 from a strong electric field, is formed on the entire rear surface of the front dielectric layer 11. Plasma forming gas fills a discharge space 14.

The plasma display panel is driven by sequentially performing a reset step, an address step, and a display sustaining step on unit subfields. In the reset step, the charge states on display cells to be driven are made uniform. In the address step, the charge state of display cells to be turned on is set, and the charge state of display cells to be turned off is also set. In the display sustaining step, the display cells to be turned on perform display discharging.

Here, multiple unit sub-fields operating based on the above-described driving principle are included in a unit frame, so a desired gray scale can be displayed by the display sustaining periods of the respective subfields.

FIG. 3 shows a conventional address-display separation driving method of the Y electrode lines of the plasma display panel of FIG. 1. Referring to FIG. 3, a unit frame is divided into 8 sub-fields SF1 through SF8 in order to achieve time-division gray scale display. Each of the sub-fields SF1 through SF8 is divided into an address period A1 through A8 and a display sustain period S1 through S8.

In each of the address periods A1 through A8, while a display data signal is applied to the address electrode lines $A_{R1}$, $A_{G1}$ through $A_{Gm}$, and $A_{Bm}$ of FIG. 1, appropriate scanning pulses are sequentially applied to the Y electrode lines $Y_1$ through $Y_n$. During the application of the scanning pulses, if a high-level display data signal is applied to an address electrode line, wall charges are formed on a discharge cell corresponding to the address electrode line, but the other discharge cells do not gain wall charges.

In each of the display sustain periods S1 through S8, a display discharge pulse is applied to all of the X electrode lines $X_1$ through $X_n$ and all of the Y electrode lines $Y_1$ through $Y_n$ in such a way that the display discharge pulse alternates between them. Thus, display discharge occurs on discharge cells having wall charges formed in each of the address periods A1 through A6. Accordingly, the luminance of a plasma display panel is proportional to the length of the display sustain periods S1 through S8 for a unit frame. In the plasma display panel of FIG. 3, the length of the display sustain periods S1 through S8 for a unit frame is 255T (T denotes a unit time). Hence, a unit frame can express 256 gray scales including a zero gray scale, where no display discharge occurs.

A time 1T, corresponding to $2^0$, is set for the display sustain period S1 of the first sub-field SF1. A time 2T, corresponding to $2^1$, is set for the display sustain period S1 of the second sub-field SF2. A time 4T, corresponding to $2^2$, is set for the display sustain period S3 of the third sub-field SF3. A time 8T, corresponding to $2^3$, is set for the display sustain period S4 of the fourth sub-field SF4. A time 16T, corresponding to $2^4$, is set for the display sustain period S5 of the fifth sub-field SF5. A time 32T, corresponding to $2^5$, is set for the display sustain period S6 of the sixth sub-field SF6. A time 64T, corresponding to $2^6$, is set for the display sustain period S7 of the seventh sub-field SF7. A time 128T, corresponding to $2^7$, is set for the display sustain period S8 of the eighth sub-field SF8.

Accordingly, it can be seen from FIG. 3 that when sub-fields to be displayed are appropriately selected from the 8 sub-fields, any of the selected sub-fields can display 256 gray scales including a zero gray scale, in which display discharge does not occur.

In the above-described address-display separation driving method, since the subfields SF1 through SF8 are temporally separated in a unit frame, the address period and the display sustain period are temporally separated in each of the subfields SF1 through SF8. More specifically, in an address period, each pair of X and Y electrodes is addressed, and waits for the next operation until the other pairs of X and Y electrodes are all addressed. Consequently, the time for the address period in each subfield is lengthened, while the display sustain period is relatively shortened. This lowers the luminance of light emitted from a plasma display panel adopting the above method. In order to solve this problem, an address-while-display driving method as shown in FIG. 4 have been developed.

FIG. 4 shows a conventional address-while-display driving method of the Y electrode lines of the plasma display panel of FIG. 1. Referring to FIG. 4, a unit frame is divided into 8 subfields $SF_1$ through $SF_8$ in order to achieve time-division gray-scale display. Here, the subfields overlap with one another with respect to the Y electrode lines $Y_1$ through $Y_n$ to constitute a unit frame. Hence, all of the subfields $SF_1$ through $SF_8$ exist at every time point and an addressing time slot is set between display discharge pulses in order to perform each addressing.

A reset step, an address step, and a display sustaining step are performed on each of the subfields, and the time allocated to each of the subfields is determined based on a display discharging time corresponding to a gray scale. If 8-bit image data displays 256 gray scales per unit frame and the unit frame (generally, 1/60 sec) is divided into 255 unit periods, the first subfield $SF_1$, driven based on the least significant bit (LSB) image data, has one ($2^0$) unit period. The second subfield $SF_2$ has 2 ($2^1$) unit periods, the third subfield $SF_3$ has 4 ($2^2$) unit periods, the fourth subfield $SF_4$ has 8 ($2^3$) unit periods, the fifth subfield $SF_5$ has 16 ($2^4$) unit periods, the sixth subfield $SF_6$ has 32 ($2^5$) unit periods, the seventh subfield $SF_7$ has 64 ($2^6$) unit periods, and the eighth subfield $SF_8$, driven based on the most significant bit (MSB) image data, has 128 ($2^7$) unit periods.

Since the sum of the unit periods allocated to the subfields is 255 unit periods, 255 gray scales can be displayed. If a gray scale in which display discharge does not occur on any subfield is included, 256 gray scales can be displayed.

FIG. 5 shows a general driving apparatus for the plasma display panel of FIG. 1. Referring to FIG. 5, the general driving apparatus for the plasma display panel 1 of FIG. 1 includes an image processor 66, a logic controller 62, an address driver 63, an X-driver 64, and a Y-driver 65. The image processor 66 converts an external analog image signal into a digital signal and generates an internal image signal, for example, 8-bit red (R) image data, 8-bit green (G) image data, 8-bit blue (B) image data, a clock signal, and vertical and horizontal synchronous signals. The logic controller 62 generates driving control signals $S_A$, $S_Y$, and $S_X$ according to the internal image signal received from the image processor 66. The address driver 63 processes the address signal $S_A$ out of the driving control signals $S_A$, $S_Y$, and $S_X$ to obtain a display data signal, and applies the display data signal to address electrode lines. The X-driver 64 processes the X driving control signal $S_X$ out of the driving control signals $S_A$, $S_Y$, and $S_X$ and applies the resultant signal to X electrode lines. The Y-driver 65 processes the Y driving control signal $S_Y$ out of the driving control signals $S_A$, $S_Y$, and $S_X$ and applies the resultant signal to Y electrode lines.

FIG. 6 shows driving signals applied to a unit subfield on the panel of FIG. 1 by the address-display separation driving method of FIG. 3. Referring to FIG. 6, reference character $S_{AR1 \ldots ABm}$ denotes a driving signal applied to the address-electrode lines $A_{R1}$, $A_{G1}$ through $A_{Gm}$, and $A_{Bm}$ of FIG. 1, reference character $S_{X1 \ldots Xn}$ denotes a driving signal applied to the X electrode lines $X_1$ through $X_n$ of FIG. 1, and reference characters $S_{Y1}$ through $S_{Yn}$ denote a driving signal applied to the Y electrode lines $Y_1$ through $Y_n$ of FIG. 1, respectively. FIG. 7 shows wall charges distributed on a display cell at the point in time immediately after a gradual rising voltage is applied to the Y electrode lines $Y_1$ through $Y_n$ during a reset period PR of FIG. 6. FIG. 8 shows wall charges distributed on a display cell at the point in time when the reset period PR of FIG. 6 terminates.

Referring to FIG. 6, during the reset period PR of a unit subfield SF, first, the voltage applied to the X electrode lines $X_1$ through $X_n$ continuously increases from a ground voltage $V_G$ to a second voltage $V_S$, for example, 155 V. At this time, the ground voltage $V_G$ is applied to the Y electrode lines $Y_1$ through $Y_n$ and the address electrode lines $A_{R1}$, $A_{G1}$ through $A_{Gm}$, and $A_{Bm}$. Accordingly, while weak discharge occurs between the X electrode lines $X_1$, through $X_n$ and the Y electrode lines $Y_1$ through $Y_n$ and between the X electrode lines $X_1$ through $X_n$ and the address electrode lines $A_{R1}$ through $A_{Rm}$, $A_{G1}$ through $A_{Gm}$ and $A_{B1}$ through $A_{BM}$, negative wall charges are formed around the X electrode lines $X_1$ through $X_n$.

Next, the voltage applied to the Y electrode lines $Y_1$ through $Y_n$ continuously increases from the second voltage $V_S$, for example, 155 V, to the highest voltage ($V_{SET}+V_S$), for example, 355 V. The voltage ($V_{SET}+V_S$) is obtained by adding a third voltage $V_{SET}$ to the second voltage $V_S$. While the voltages $S_{Y1}$ through $S_{Yn}$ increase from the second voltage to the highest voltage, the ground voltage $V_G$ is applied to the X electrode lines $X_1$ through $X_n$ and the address electrode lines $A_{R1}$ through $A_{Bm}$. Accordingly, weak discharge occurs between the X electrode lines $X_1$ through $X_n$ and the Y electrode lines $Y_1$ through $Y_n$, while weaker discharge occurs between the Y electrode lines $Y_1$ through $Y_n$ and the address electrode lines $A_{R1}$, $A_{G1}$ through $A_{Gm}$, and $A_{Bm}$. The reason why the discharge between the X electrode lines $X_1$ through $X_n$ and the Y electrode lines $Y_1$ through $Y_n$ is stronger than the discharge between the Y electrode lines $Y_1$ through $Y_n$ and the address electrode lines $A_{R1}$, $A_{G1}$ through $A_{Gm}$, and $A_{Bm}$ is that negative wall charges have been formed around the X electrode lines $X_1$ through $X_n$. Consequently, many negative wall charges are formed around the Y electrode lines $Y_1$ through $Y_n$, positive wall charges are formed around the X electrode lines $X_1$ through $X_n$, and a few positive wall charges are formed around the address electrode lines $A_{R1}$, $A_{G1}$ through $A_{Gm}$, and $A_{Bm}$, as illustratively shown in FIG. 7.

Thereafter, while the voltage applied to the X electrode lines $X_1$ through $X_n$ is maintained at the second voltage $V_S$, the voltage applied to the Y electrode lines $Y_1$ through $Y_n$ continuously decreases from the second voltage $V_S$ to the ground voltage $V_G$. At this time, the ground voltage $V_G$ is applied to the address electrode lines $A_{R1}$, $A_{G1}$ through $A_{Gm}$, and $A_{Bm}$. Consequently, due to weak discharge occurring between the X electrode lines $X_1$ through $X_n$ and the Y electrode lines $Y_1$ through $Y_n$, some of the negative wall charges around the Y electrode lines $Y_1$ through $Y_n$ move toward the X electrode lines $X_1$ through $X_n$, as illustratively shown in FIG. 8. Also, due to the ground voltage $V_G$ applied to the address electrode lines $A_{R1}$, $A_{G1}$ through $A_{Gm}$, and $A_{Bm}$, the number of positive wall charges around the address electrode lines $A_{R1}$, $A_{G1}$ through $A_{Gm}$, and $A_{Bm}$ slightly increases.

Subsequently, during the subsequent address period PA, smooth addressing can be performed accordingly as a display data signal is applied to the address electrode lines $A_{R1}$, $A_{G1}$ through $A_{Gm}$, and $A_{Bm}$. The Y electrode lines $Y_1$ through $Y_n$, biased to a fourth voltage $V_{SCAN}$, which is lower than the second voltage $V_S$, are sequentially subject to a scanning signal with the ground voltage $V_G$. If a display cell is selected, a display data signal with positive address voltage $V_A$ is applied to a corresponding address electrode line. Otherwise, a display data signal with the ground voltage $V_G$ is applied to a corresponding address electrode line. Accordingly, when a display data signal with the positive address voltage $V_A$ is applied while a scanning pulse with the ground voltage $V_G$ is applied, a display cell corresponding to this case has wall charges formed on a corresponding display cell due to address discharge.

Otherwise, a display cell corresponding to this case does not have wall charges. At this time, in order to achieve more accurate and efficient address discharge, the second voltage $V_S$ is applied to the X electrode lines $X_1$ through $X_n$.

Subsequently, during the display sustaining period PS, a display sustaining pulse with the second voltage $V_S$ is applied to each of the X electrode lines $X_1$ through $X_n$ and each of the Y electrode lines $Y_1$ through $Y_n$ in such a way that the display sustaining pulse alternates between them. As a result, discharge for sustaining display occurs on display cells having wall charges formed during the address period PA.

In FIG. 9A, reference character $S_{Y1 \ldots Yn}$ denotes a driving signal applied to all of the Y electrode lines $Y_1$ through $Y_n$, and reference character $S_{X1 \ldots Xn}$ denotes a driving signal applied to all of the X electrode lines $X_1$ through $X_n$. Referring to FIG. 9A, the widths of conventional alternating current (AC) pulses and pulse periods applied during the display sustaining period are uniform. Accordingly, during the display sustaining period, an AC pulse of a single period (T1), that is, a single frequency (1/T1), is applied.

As shown illustratively in FIG. 9B, in a conventional driving method as described above, the maximum electric field intensity $E_{OLD}$ for a particular frequency f1 increases, which increases the influence of electromagnetic interference (EMI).

SUMMARY OF THE INVENTION

It is an object of the present invention to provide a driving method of a plasma display panel, by which electromagnetic interference is reduced.

To achieve the above object, the present invention provides a plasma display panel driving method in which a reset step, an address step, and a display sustaining step are performed on unit subfields. In the reset step, the charge states of display cells to be driven are uniform. In the address step, wall charges with a predetermined voltage are formed on only display cells to be turned on. In the display sustaining step, alternating current pulses are applied to all of the display cells, so that only the display cells having the wall charges perform display discharge. The width of AC pulses applied to all of the display cells varies in the display sustain step.

In the driving method according to the present invention, the width of AC pulses applied to all of the display cells varies in the display sustaining step so that the electric field due to the AC pulses is dispersed with respect to a plurality of frequencies. In this way, electromagnetic interference is reduced.

BRIEF DESCRIPTION OF THE DRAWINGS

The above and other objects and advantages of the present invention will become more apparent by describing in detail preferred embodiments with reference to the attached drawings.

DETAILED DESCRIPTION OF THE INVENTION

A driving method of the 3-electrode plasma display panel 1 according to preferred embodiments of the present invention are now described with reference to FIGS. 1 through 6. In the driving method, a reset step PR, an address step PA, and a display sustaining step PS are performed on unit subfields SF. In the 3-elctrode plasma display panel 1, the X electrode lines $X_1$ through $X_n$ and the Y electrode lines $Y_1$ through $Y_n$ are disposed parallel to one another on the rear surface of the front transparent substrate 10 with X electrode lines alternating with the Y electrode lines forming XY electrode line pairs $X_1Y_1$ through $X_nY_n$. The address electrode lines $A_{R1}$, $A_{G1}$ through $A_{Gm}$, and $A_{Bm}$ are disposed on the front surface of the rear transparent substrate 13 intersecting the XY electrode line pairs $X_1Y_1$ through $X_nY_n$, such that display cells are defined at the intersections. In the reset step PR, charges on display cells to be driven are arranged uniformly. In the address step PA, wall charges with a predetermined voltage are only formed on display cells to be turned on. In the display sustaining step PS, alternating current pulses are applied to all of the display cells, such that only the display cells having wall charges perform display discharge. Also, in the display sustaining step PS, the width of alternating current pulses applied to the display cells varies.

Figure 1:
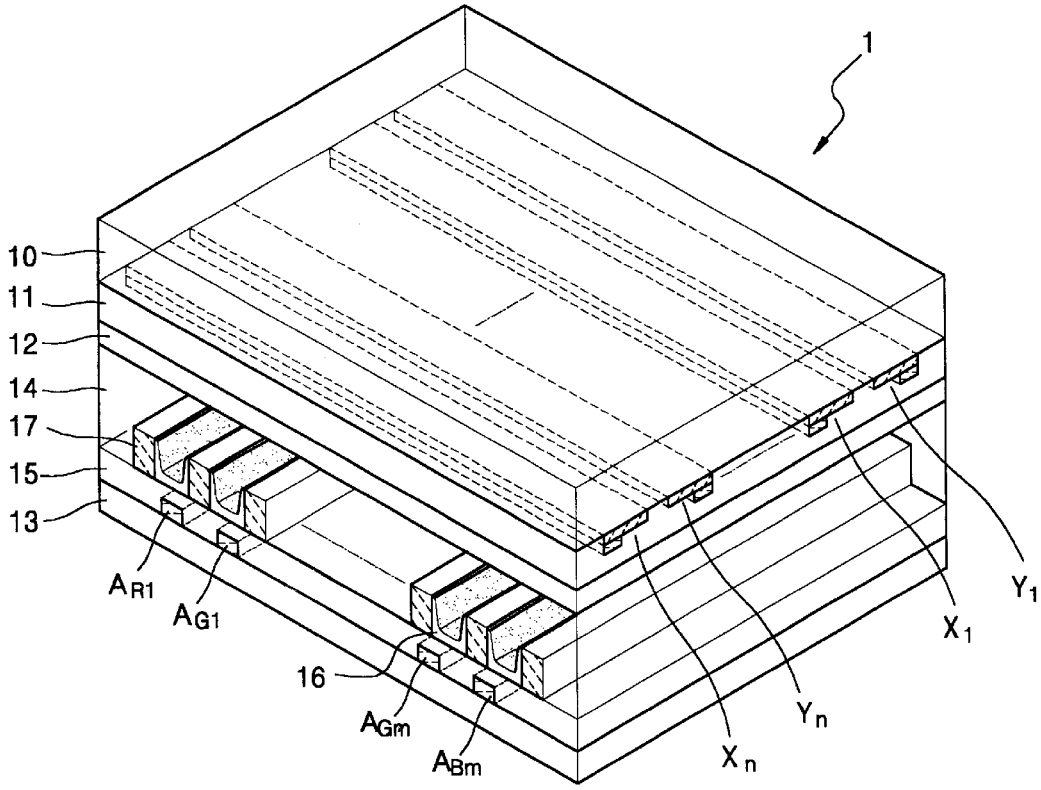
FIG. 1 (RELATED ART)
FIG. 1 is an internal perspective view of the structure of a general 3-electrode surface-discharge type plasma display panel.
Figure 2:
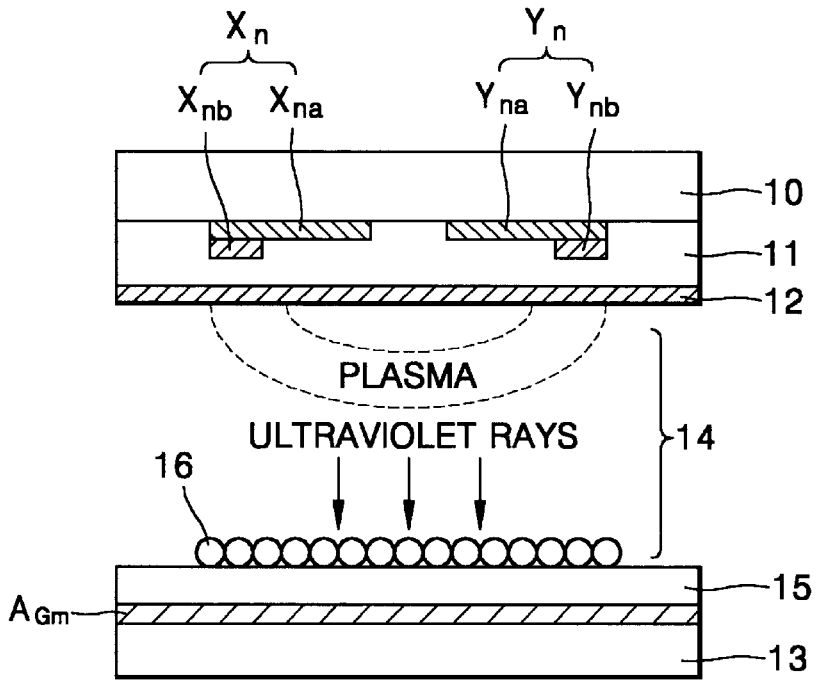
FIG. 2 (RELATED ART)
FIG. 2 is a cross-section of a display cell of the panel of FIG. 1.
Figure 3:
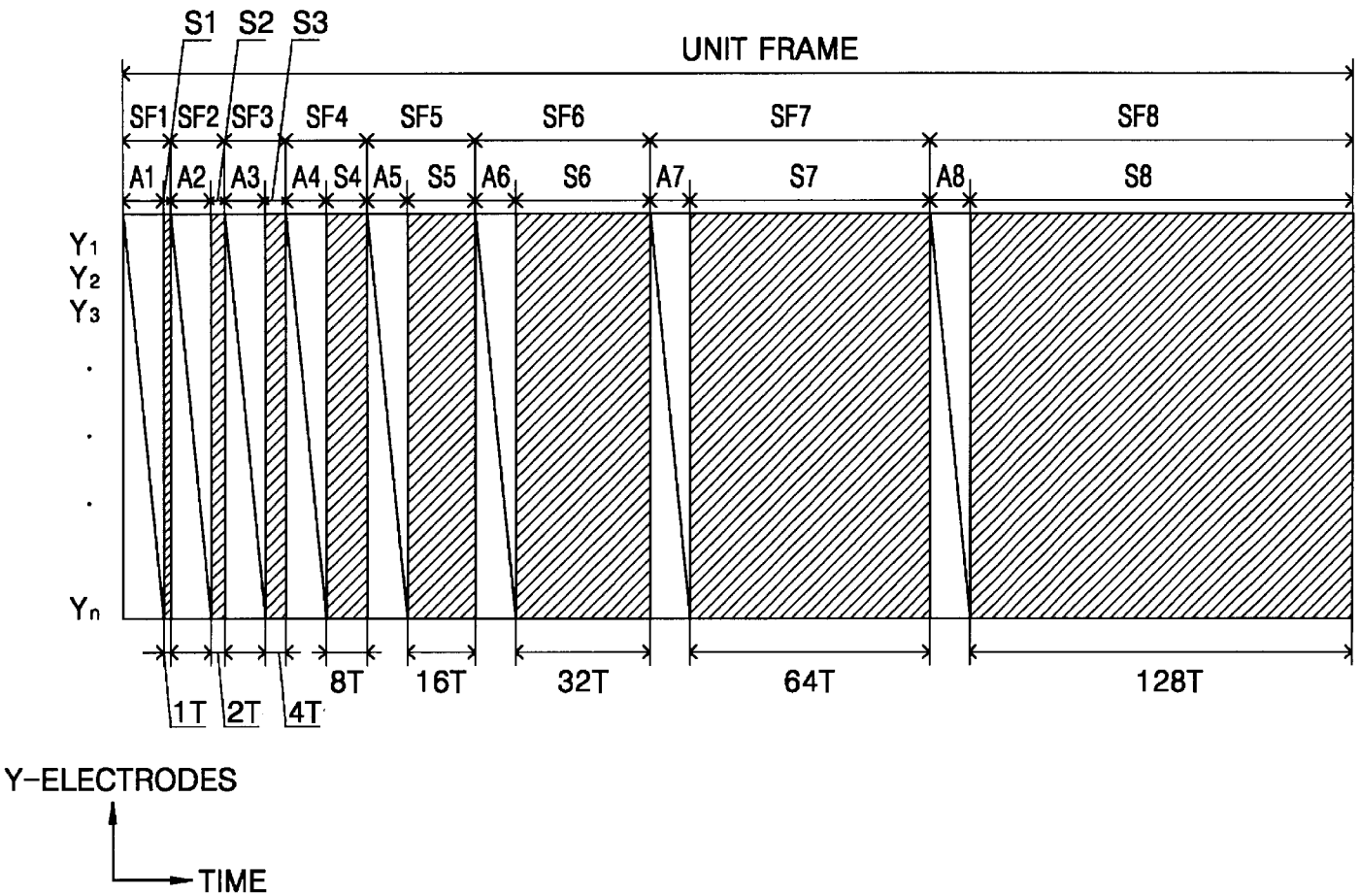
FIG. 3 (RELATED ART)
FIG. 3 is a timing diagram showing a conventional address-display separation driving method of the Y electrode lines of the plasma display panel of FIG. 1.
Figure 4:
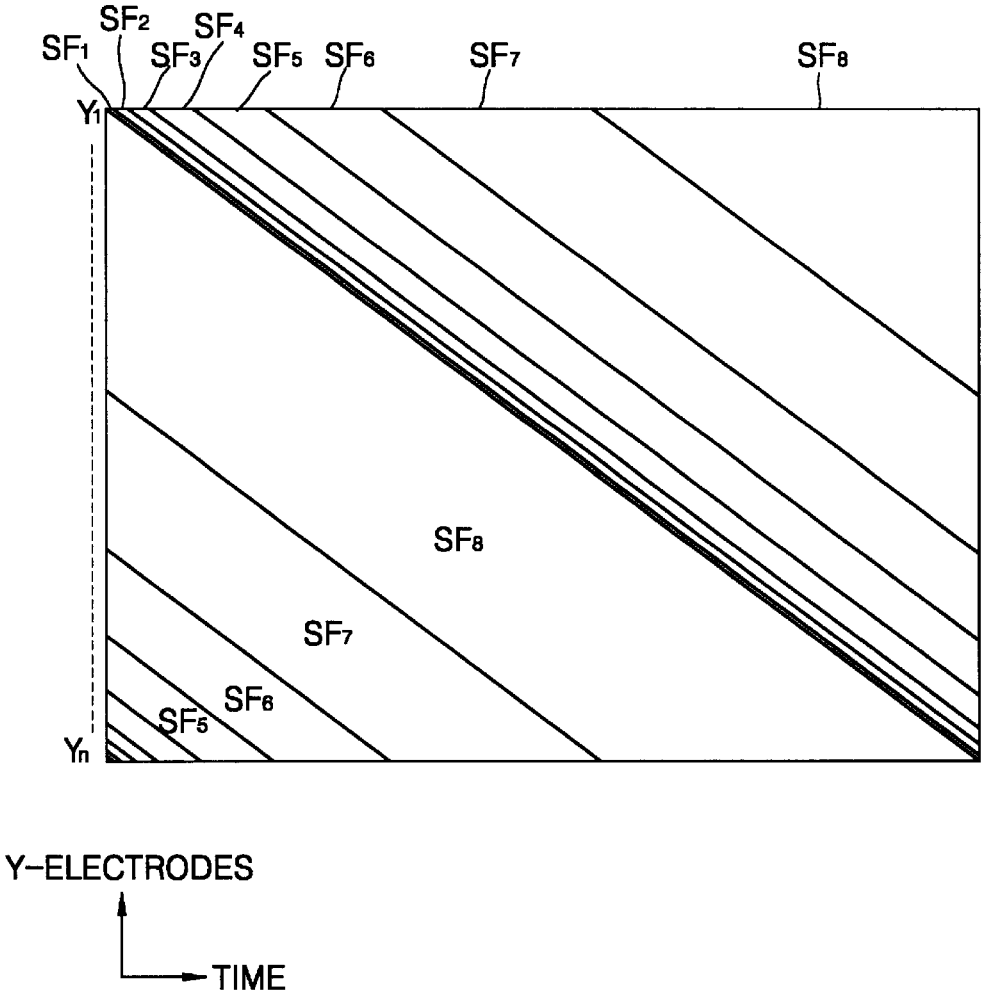
FIG. 4 (RELATED ART)
FIG. 4 is a timing diagram showing a conventional address-while-display driving method of the Y electrode lines of the plasma display panel of FIG. 1.
Figure 5:
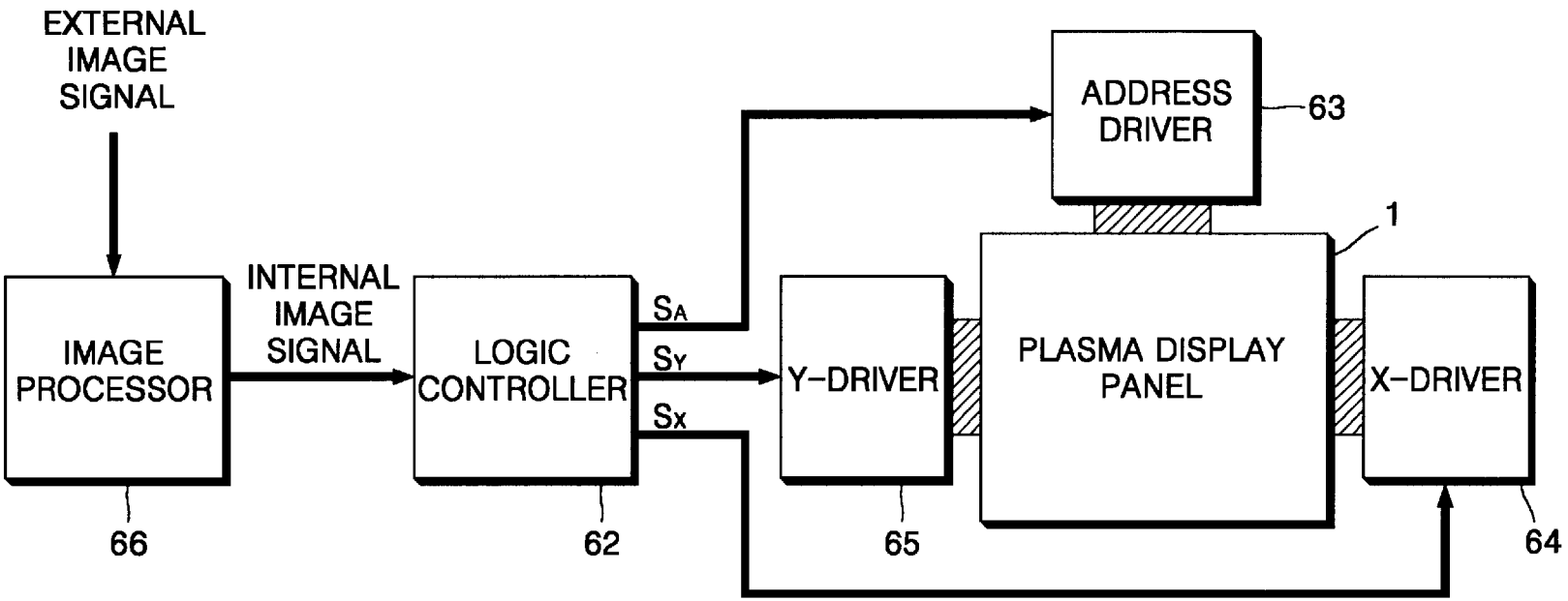
FIG. 5 (RELATED ART)
FIG. 5 is a block diagram of a general driving apparatus for the plasma display panel of FIG. 1.
Figure 6:
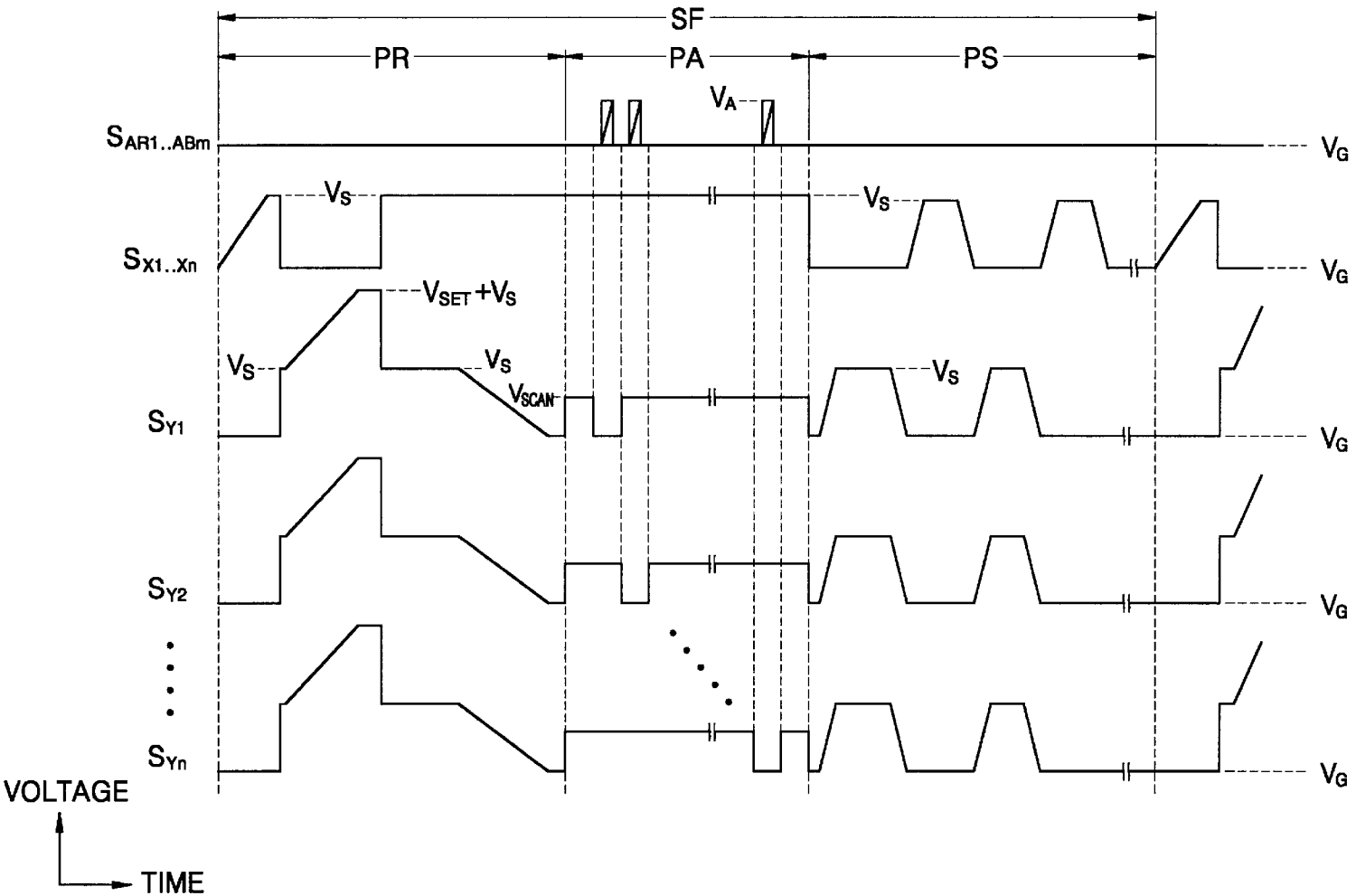
FIG. 6 (RELATED ART)
FIG. 6 is a timing diagram showing driving signals applied to a unit subfield on the panel of FIG. 1 by the address-display separation driving method of FIG. 3.
Figure 7:
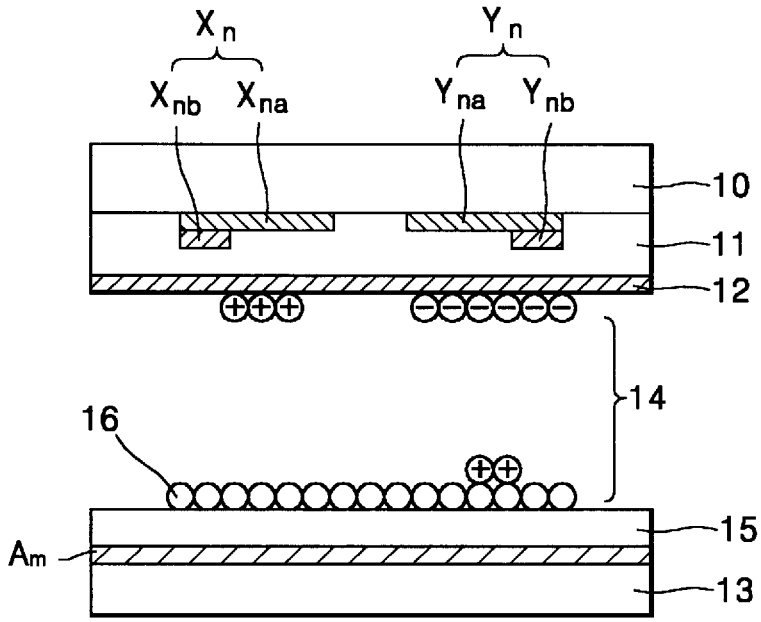
FIG. 7 (RELATED ART)
FIG. 7 is a cross-sectional view showing wall charges distributed on a display cell at the point in time immediately after a gradual rising voltage is applied to the Y electrode lines during the reset period of FIG. 6.
Figure 8:
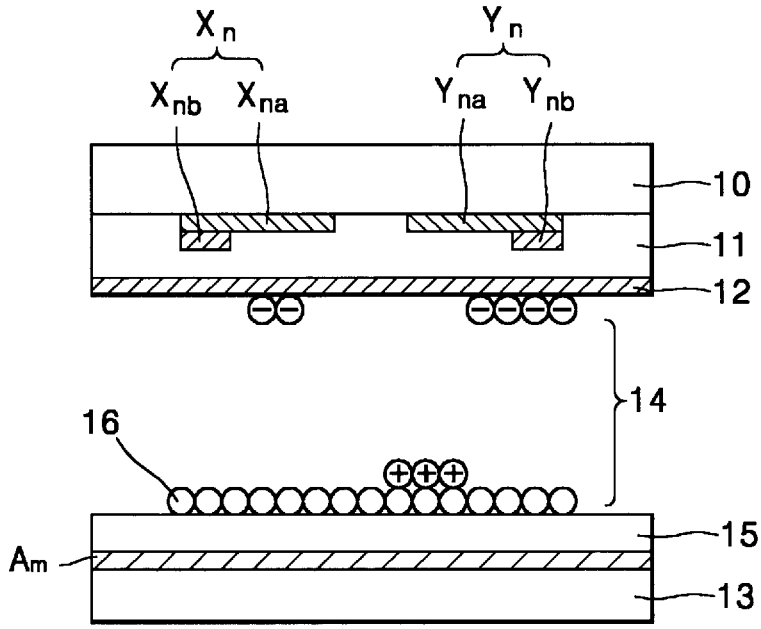
FIG. 8 (RELATED ART)
FIG. 8 is a cross-sectional view showing wall charges distributed on a display cell at the point in time when the reset period of FIG. 6 is terminated.
Figure 9A:
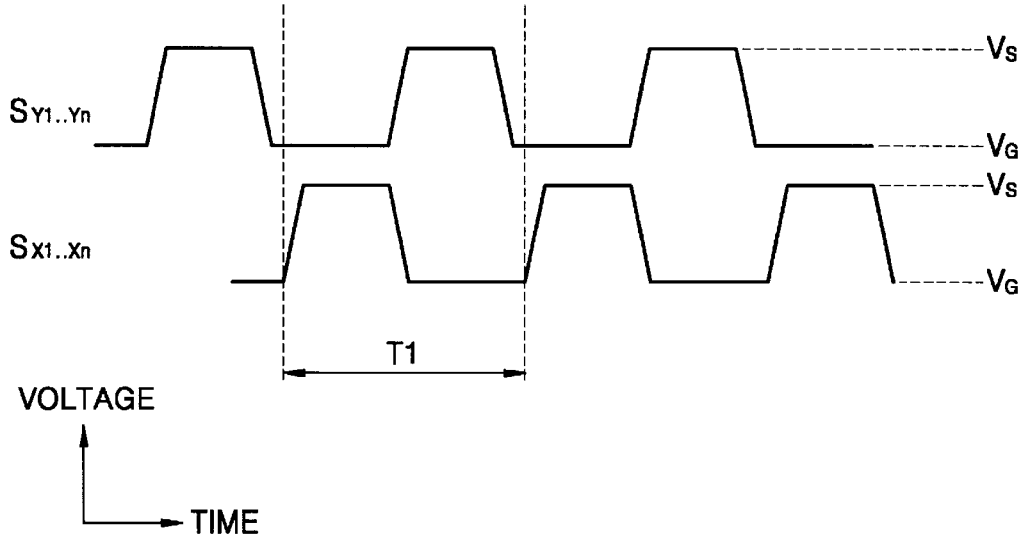
FIG. 9A (RELATED ART)
FIG. 9A is a timing diagram showing the waveforms of conventional alternating current pulses applied during a display sustaining period.
Figure 9B:
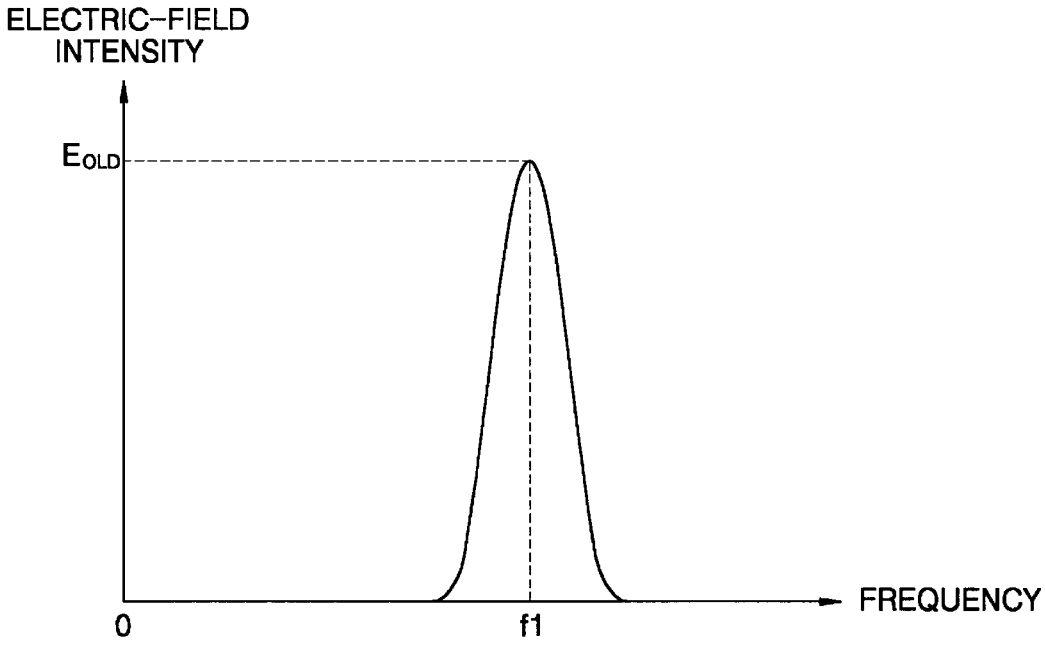
FIG. 9B (RELATED ART)
FIG. 9B is a graph showing the electric field intensity with respect to the frequency of the display sustain pulses of FIG. 9A.
Figure 10A:
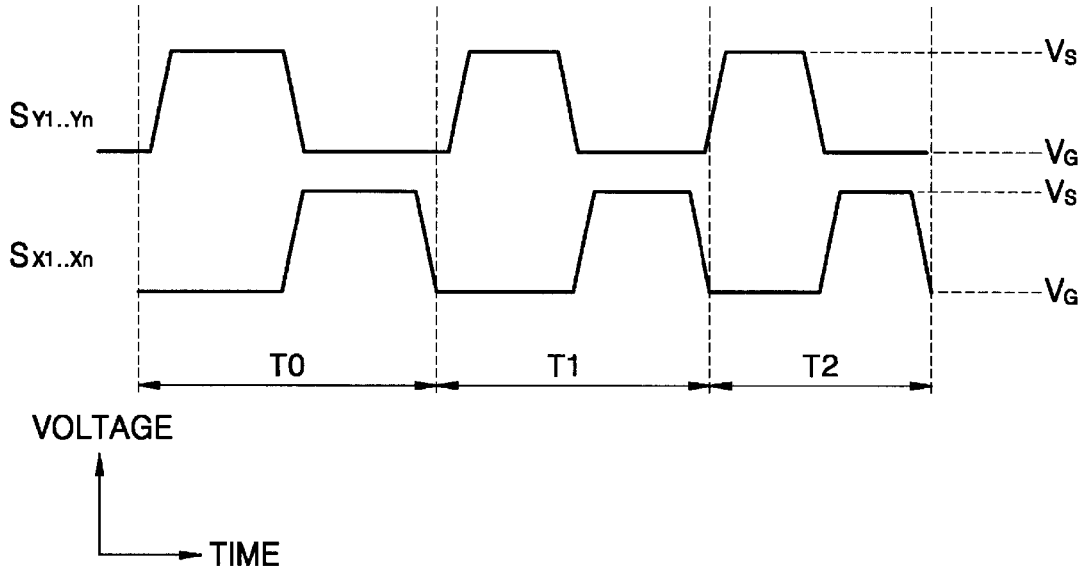
FIG. 10A is a timing diagram showing the waveforms of alternating current pulses according to a first embodiment of the present invention, which are applied during a display sustaining period.

FIG. 10A shows the waveforms of alternating current (AC) pulses according to an embodiment of the present invention, which are applied during the display sustaining period PS of FIG. 6. In FIG. 10A, reference character $S_{Y1 \ldots Yn}$ denotes a driving signal applied to the Y electrode lines $Y_1$ through $Y_n$ of FIG. 1. Reference character $S_{X1 \ldots Xn}$ denotes a driving signal applied to the X electrode lines $X_1$ through $X_n$ of FIG. 1. Reference characters $V_S$ and $V_G$ denote a display sustain voltage and a ground voltage, respectively. Referring to FIG. 10A, the total width of a first pulse period applied to the Y electrode lines $Y_1$ through $Y_n$ and the total width of a second pulse period applied to the X electrode lines $X_1$ through $X_n$ is periodically shortened as shown illustratively by the varying (i.e., shortening) pulse period widths of T0, T1, and T2. The pattern is subsequently repeated.

Figure 10B:
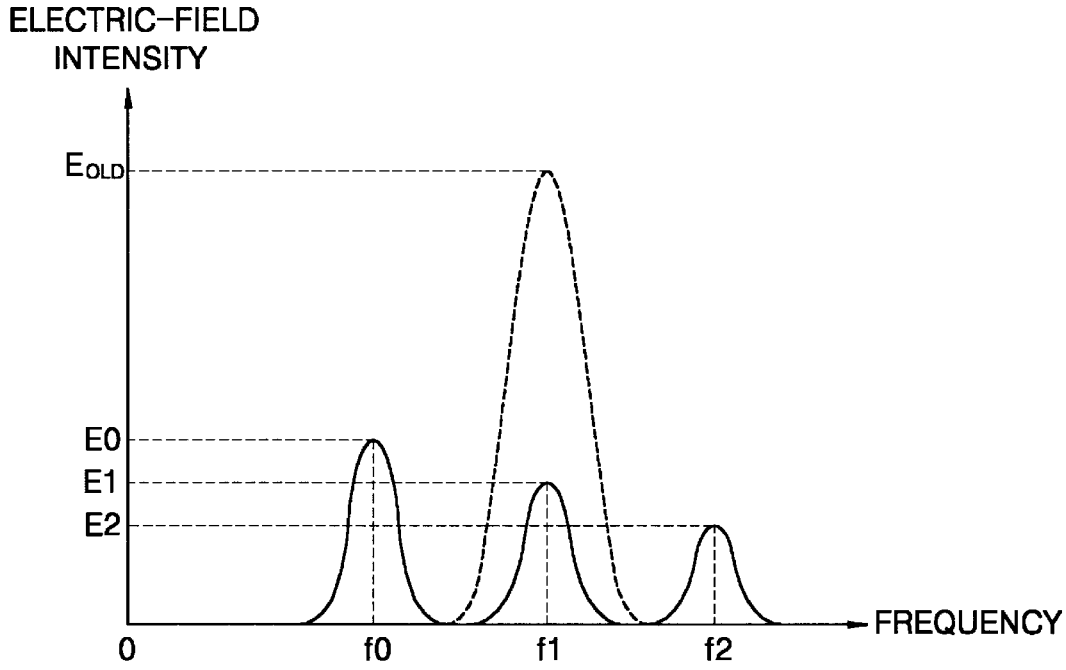
FIG. 10B is a graph showing the electric field intensity with respect to the frequency of the display sustain pulses of FIG. 10A.

As a result, as shown illustratively in FIG. 10B, the conventional maximum electric field intensity $E_{OLD}$ for a particular frequency f1 is broke up with respect to three frequencies f0, f1, and f2. Reference character E0 denotes the electric field intensity with respect to the frequency f0 (1/T0), reference character E1 denotes the electric field intensity with respect to the frequency f1 (1/T1), and reference character E2 denotes the electric field intensity with respect to the frequency f2 (1/T2). As shown in FIG. 10B, the maximum electric field intensity based on the AC pulses is broken up and spread over several frequencies such that the influence of electro-magnetic interference is reduced.

Figure 11A:
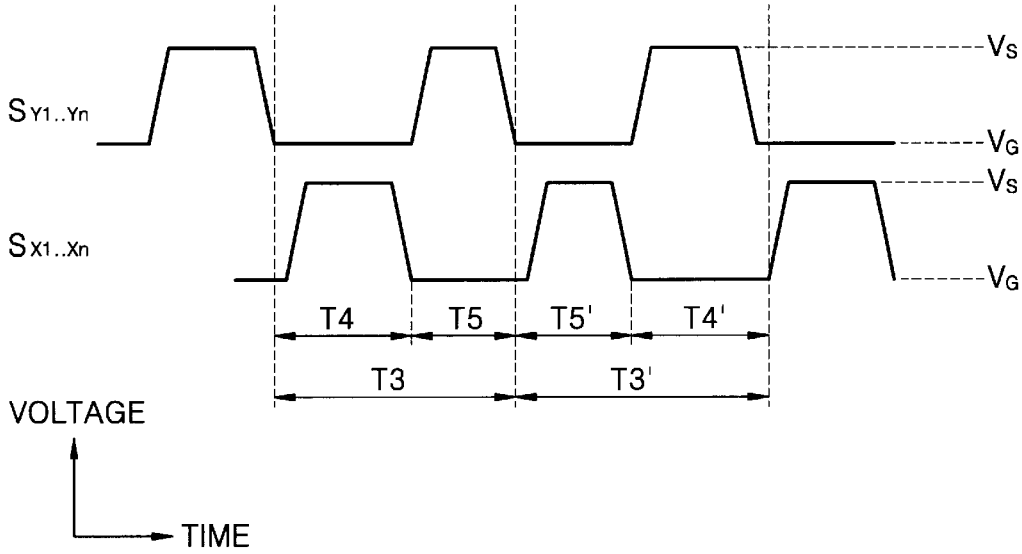
FIG. 11A is a timing diagram showing the waveforms of alternating current pulses according to a second embodiment of the present invention, which are applied during a display sustaining period.

FIG. 11A is a timing diagram showing the waveforms of AC pulses according to another embodiment of the present invention, which are applied during a display sustaining period. In FIG. 11A, reference character $S_{Y1 \ldots Yn}$ denotes a driving signal applied to the Y electrode lines $Y_1$ through $Y_n$ of FIG. 1. Reference character $S_{X1 \ldots Xn}$ denotes a driving signal applied to the X electrode lines $X_1$ through $X_n$ of FIG. 1. Reference characters $V_S$ and $V_G$ denote a display sustain voltage and a ground voltage, respectively. Referring to FIG. 11A, T3 designates a period of a pulse and is composed of a first portion T4 or a second portion T5. A portion, e.g., first portion or second portion, refers to the part of a pulse period when the voltage is substantially at $V_S$. The pulse period T3 of a first pulse applied to the X electrode lines $X_1$ through $X_n$ and the pulse period T3 of a second pulse applied to the Y electrode lines $Y_1$ through $Y_n$ is uniform and are generally related as shown by T3, T4, and T5. However, during a first T3 period, the width of first portion T4 of the first pulse is greater than the width of the second portion T5 of the second pulse.

During a second period T3', the width of first portion T4' of another second pulse is greater than the width of second portion T5' of another first pulse. This first period and second period pattern repeats until a unit subfield is terminated.

Figure 11B:
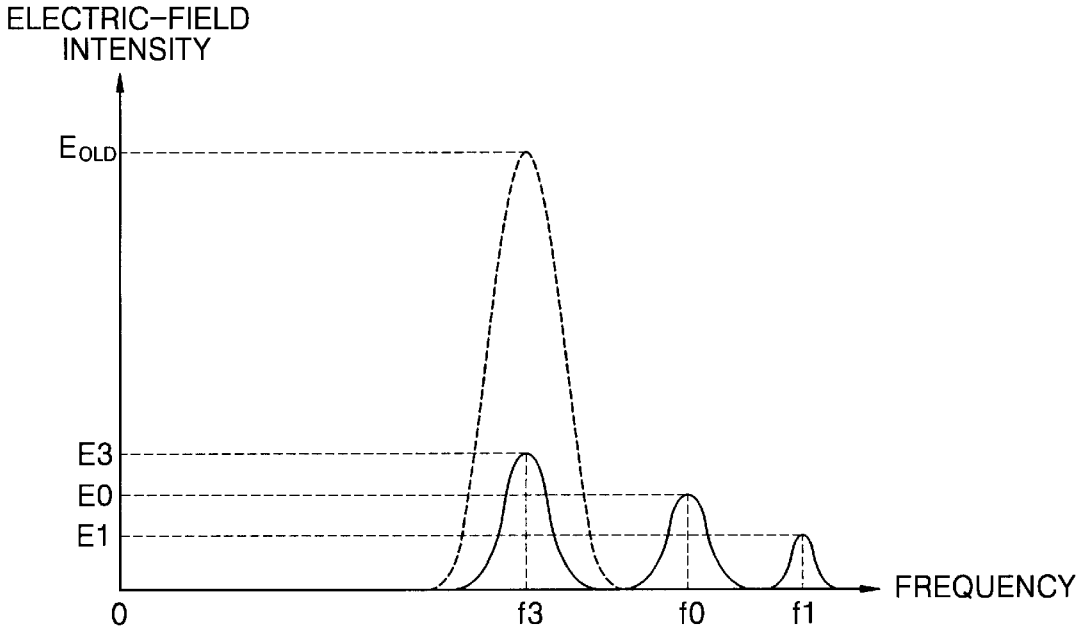
FIG. 11B is a graph showing the electric field intensity with respect to the frequency of the display sustain pulses of FIG. 11A.

Accordingly, as shown in FIG. 11B, the conventional maximum electric field intensity $E_{OLD}$ for a particular frequency f3 is broken up with respect to three frequencies f3, f0, and f1. In FIG. 11B, reference character E3 denotes the electric field intensity with respect to the frequency f3 (1/T3), reference character E0 denotes the electric field intensity with respect to the frequency f0 (1/T0), and reference character E1 denotes the electric field intensity with respect to the frequency f1 (1/T1). The maximum electric field intensity based on the AC pulses is broken up and spread over several frequencies such that the influence of electro-magnetic interference is reduced.

Figure 12A:
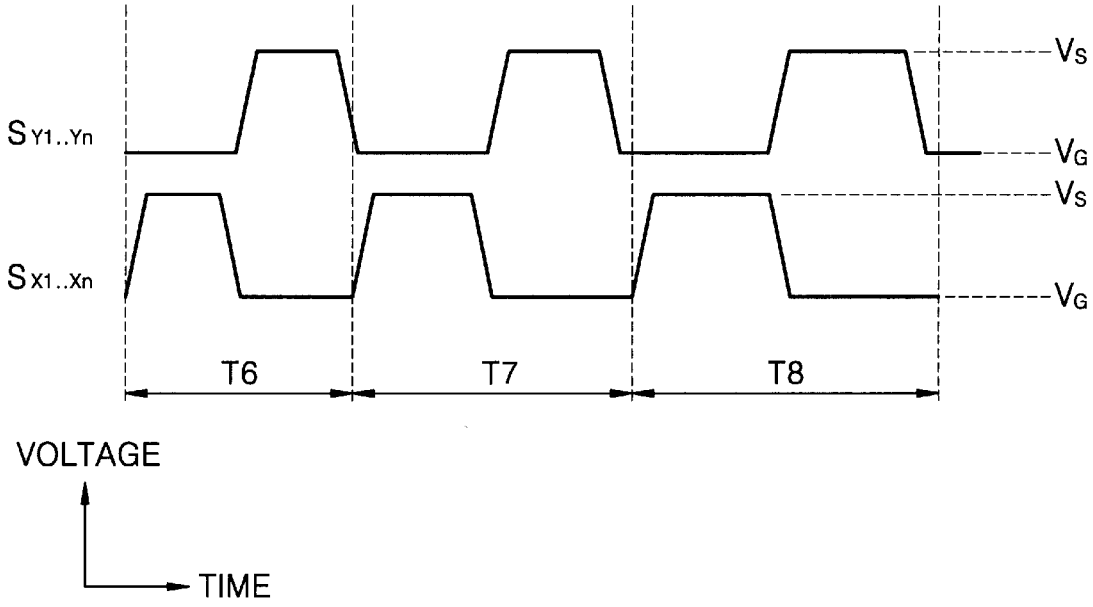
FIG. 12A is a timing diagram showing the waveforms of alternating current pulses according to a third embodiment of the present invention, which are applied during a display sustaining period.

FIG. 12A shows the waveforms of AC pulses according to another embodiment of the present invention, which are applied during a display sustaining period. Reference character $S_{Y1 \ldots Yn}$ denotes a driving signal applied to the Y electrode lines $Y_1$ through $Y_n$ of FIG. 1. Reference character $S_{X1 \ldots Xn}$ denotes a driving signal applied to the X electrode lines $X_1$ through $X_n$ of FIG. 1. Reference characters $V_S$ and $V_G$ denote a display sustain voltage and a ground voltage, respectively. Referring to FIG. 12A, the width of a first pulse applied to the X electrode lines $X_1$ through $X_n$ and the width of a second pulse applied to the Y electrode lines $Y_1$ through $Y_n$ is periodically lengthened as shown illustratively by the varying widths of T6, T7, and T8. A first pulse and a second pulse are essentially synchronized.

Figure 12B:
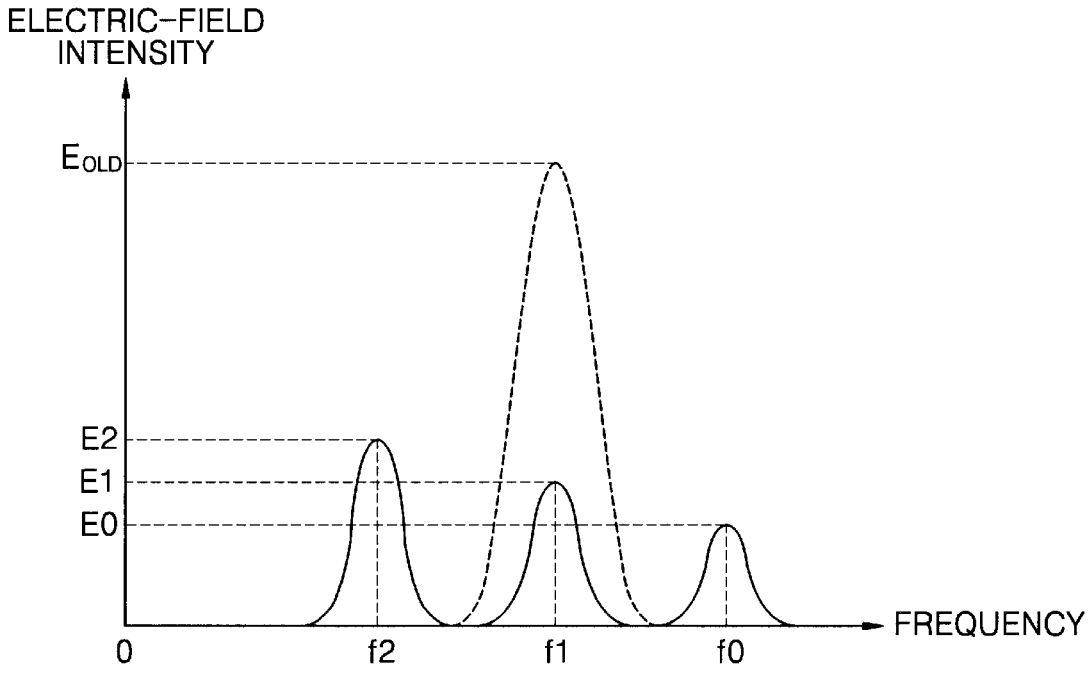
FIG. 12B is a graph showing the electric field intensity with respect to the frequency of the display sustain pulses of FIG. 12A.

Accordingly, as shown in FIG. 12B, the conventional maximum electric field intensity $E_{OLD}$ for a particular frequency f1 is broke up with respect to three frequencies f0, f1, and f2. Reference character E0 denotes the electric field intensity with respect to the frequency f0 (1/T0), reference character E1 denotes the electric field intensity with respect to the frequency f1 (1/T1), and reference character E2 denotes the electric field intensity with respect to the frequency f2 (1/T2). As shown in FIG. 12B, the maximum electric field intensity based on the AC pulses is broken up and spread across several frequencies such that the influence of electro-magnetic interference is reduced.

Figure 13A:
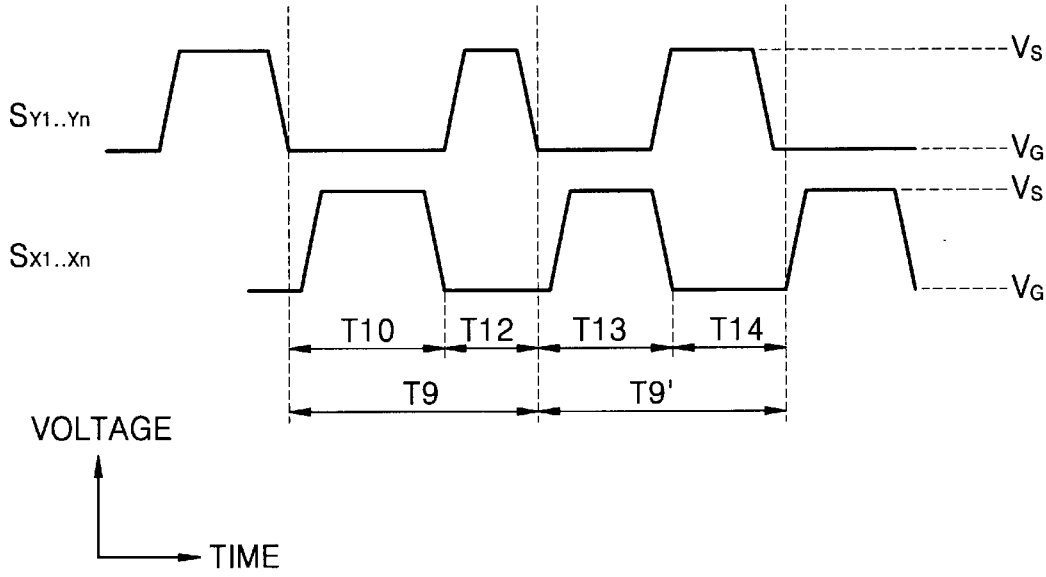
FIG. 13A is a timing diagram showing the waveforms of alternating current pulses according to a fourth embodiment of the present invention, which are applied during a display sustaining period.

FIG. 13A show the waveforms of AC pulses according to another embodiment of the present invention, which are applied during a display sustaining period. Reference character $S_{Y1 \ldots Yn}$ denotes a driving signal applied to the Y electrode lines $Y_1$ through $Y_n$ of FIG. 1. Reference character $S_{X1 \ldots Xn}$ denotes a driving signal applied to the X electrode lines $X_1$ through $X_n$ of FIG. 1. Reference characters $V_S$ and $V_G$ denote a display sustain voltage and a ground voltage, respectively. Referring to FIG. 13A, the pulse period T9 of a first pulse applied to the X electrode lines $X_1$ through $X_n$ and the pulse period T9 of a second pulse applied to the Y electrode lines $Y_1$ through $Y_n$ is is uniform and synchronized.

A pulse period T9 may include a first portion T10, a second portion T12, a third portion T13, or a fourth portion T14. A portion is that part of a pulse period substantially at $V_S$. The width of the first portion T10 is wider than the width of the third portion T13. The third portion T13 is wider than the width of the fourth portion T14. The fourth portion T14 is wider than the width of the second portion T12.

If a first pulse is applied having a first portion T10, the corresponding synchronized second pulse then has a second portion T12, as illustrated by pulse period T9. However, if a first pulse is applied having a third portion T13, then the corresponding synchronized second pulse has a fourth portion T14, as illustrated by by the next pulse T9'. The pulses T9 and T9' then alternate.

Figure 13B:
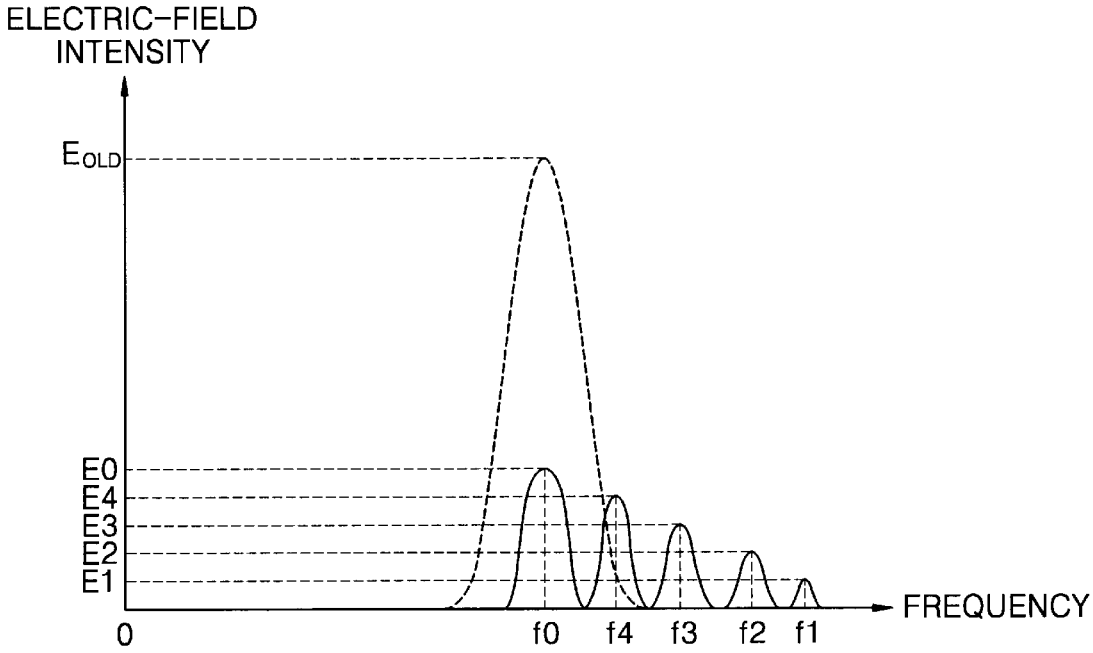
FIG. 13B is a graph showing the electric field intensity with respect to the frequency of the display sustain pulses of FIG. 13A.

Accordingly, as shown in FIG. 13B, the conventional maximum electric field intensity $E_{OLD}$ for a particular frequency f0 is broken up with respect to five frequencies f0, f4, f3, f2, and f1. Reference character E0 denotes the electric field intensity with respect to the frequency f0 (1/T0), reference character E4 denotes the electric field intensity with respect to the frequency f4 (1/T4), reference character E3 denotes the electric field intensity with respect to the frequency f3 (1/T3), reference character E2 denotes the electric field intensity with respect to the frequency f2 (1/T2), and reference character E1 denotes the electric field intensity with respect to the frequency f1 (1/T1). As illustratively shown in FIG. 13B, the maximum electric field intensity based on the AC pulses is broken up and spread over several frequencies, such that the influence of electromagnetic interference is reduced.

As described above, in a driving method according to the present invention, the width of AC pulses applied to all of the display cells varies in a display sustaining step, so that the electric field due to the AC pulses is dispersed with respect to a plurality of frequencies. This results in a reduction of electromagnetic interference.

While the present invention has been particularly shown and described with reference to preferred embodiments thereof, it will be understood by those of ordinary skill in the art that various changes in form and details may be made therein without departing from the spirit and scope of the present invention as defined by the appended claims.

Having thus described our invention, what we claim as new and desire by Letters Patent is as follows:

1. A method for driving a plasma display panel, the method comprising:

a reset step of arranging uniformly the charge states of display cells to be driven;

an address step of forming wall charges with a predetermined voltage on only display cells to be turned on; and a display sustaining step of applying alternating current (AC) pulses to all of the display cells so that only the display cells having the wall charges perform display discharge, wherein the width of AC pulses applied to all of the display cells varies in the display sustaining step.

2. The method of claim 1, wherein the width of the AC pulses increases in the display sustaining step.

3. The method of claim 1 wherein the width of the AC pulses decreases in the display sustaining step.

4. A driving method for a 3-electrode plasma display panel having a front transparent substrate, X electrode lines and Y electrode lines disposed parallel to one another on the rear surface of the front transparent substrate in such a way that the X electrode lines alternate with the Y electrode lines in order to obtain XY electrode line pairs, a rear transparent substrate, address electrode lines disposed on the front surface of the rear transparent substrate so as to intersect the XY electrode line pairs, and display cells defined at the intersections, the driving method comprising:

a reset step of creating uniformly the charge states of display cells to be driven;

an address step of forming wall charges with a predetermined voltage on only display cells to be turned on; and a display sustaining step of applying alternating current pulses to all of the display cells so that only the display cells having the wall charges perform display discharge, wherein the width of AC pulses applied to all of the display cells varies in the display sustaining step.

5. The driving method of claim 4, wherein the display sustaining step further comprises the steps of:

applying a first pulse to all the X electrode lines; and applying a second pulse to all the Y electrode lines, wherein the first pulse and the second pulse have the same pulse period, and the first pulse and the second pulse each includes one of a first portion and a second portion, the sum of the first portion and the second portion equals the width of the period, and when the first pulse includes the first portion then the second pulse includes the second portion, and when the first pulse includes the second portion then the second pulse includes the first portion, the first portion and the second portion substantially at a sustain display voltage level.

6. The driving method of claim 5, wherein the first portion and the second portion are equal widths.

7. The driving method of claim 5, wherein the first portion and the second portion are unequal widths.

8. The driving method of claim 5, wherein the pulse period of the first pulse and the pulse period of the second pulse increases.

9. The driving method of claim 5, wherein the pulse period of the first pulse and the pulse period of the second pulse decreases.

10. A driving method for a 3-electrode plasma display panel having a front transparent substrate, X electrode lines and Y electrode lines disposed parallel to one another on the rear surface of the front transparent substrate in such a way that the X electrode lines alternate with the Y electrode lines in order to obtain XY electrode line pairs, a rear transparent substrate, address electrode lines disposed on the front surface of the rear transparent substrate so as to intersect the XY electrode line pairs, and display cells defined at the intersections, the driving method comprising:

a reset step of creating uniformly the charge states of display cells to be driven;

an address step of forming wall charges with a predetermined voltage on only display cells to be turned on; and a display sustaining step of applying alternating current (AC) pulses to all of the display cells so that only the display cells having the wall charges perform display discharge, wherein the pulse period of AC pulses applied to all of the display cells is constant in the display sustaining step, and wherein a portion of the AC pulses varies, the portion substantially at a sustain voltage level $V_s$.

11. The method of claim 10, wherein the display sustaining step further comprises the steps of:

applying a first pulse to all X electrode lines; and applying a second pulse to all Y electrode lines, wherein the first pulse and the second pulse have the same pulse period and the first pulse and the second pulse includes one of a first portion and a second portion, the sum of the first portion and the second portion equals the width of the pulse period, the width of first portion and the width of second portion being unequal, and when the first pulse includes a first portion then the second pulse includes the second portion, and when the first pulse includes a first portion a next first pulse includes a second portion, and when a second pulse includes a second portion then a next second pulse includes a first portion.

12. The method of claim 11, wherein the first portion is larger than the second portion.

13. The method of claim 11, wherein the second portion is larger than the first portion.

14. The method of claim 11, wherein the first portion decreases in width from the first pulse to the next first pulse.

15. The method of claim 11, wherein the second portion increases in width from the second pulse to a next second pulse.

16. The method of claim 10, wherein the display sustaining step further comprises the steps of:

applying a first pulse to all X electrode lines; and applying a second pulse to all Y electrode lines, wherein the first pulse and the second pulse have the same pulse period and the first pulse and the second pulse includes one of a first portion and a second portion, the sum of the first portion and the second portion equals the width of the pulse period, the width of first portion and the width of second portion being unequal, and wherein the next first pulse and the next second pulse have the same pulse period and the next first pulse and the next second pulse includes one of a third portion and a fourth portion, the sum of the third portion and the fourth portion equals the width of the pulse period, the width of the third portion and the width of the fourth portion being unequal.

17. The method of claim 16, wherein the width of first portion is greater than the width of the third portion.

18. The method of claim 16, wherein the width third portion is greater than the width of the fourth portion.

19. The method of claim 16, wherein the fourth portion is greater than the width of the second portion.

20. The method of claim 16, wherein the first pulse alternates with the next first pulse, and the second pulse alternates with the next second pulse, resulting in a reduction of electromagnetic interference.

* * * * *